US006923708B1

(12) United States Patent
Coons

(10) Patent No.: US 6,923,708 B1
(45) Date of Patent: Aug. 2, 2005

(54) NOISE GENERATING DEVICE

(76) Inventor: Craig Coons, 146-03 13th Ave., Whitestone, NY (US) 11357

( * ) Notice: Subject to any disclaimer, the term of this patent is extended or adjusted under 35 U.S.C. 154(b) by 75 days.

(21) Appl. No.: 10/782,111

(22) Filed: Feb. 19, 2004

(51) Int. Cl.[7] ..... A63H 5/00
(52) U.S. Cl. ..... 446/397
(58) Field of Search ..... 446/397, 200–209, 446/175, 204, 404, 408

(56) References Cited

U.S. PATENT DOCUMENTS 1,959,169 A 5/1934 Marinacci et al.
5,820,437 A 10/1998 Coleman et al.
6,257,949 B1 7/2001 Vickers

*Primary Examiner*—Derris H. Banks
*Assistant Examiner*—Faye Francis

(57) ABSTRACT

A noise generating device for generating a nuisance noise to disturb a person. The noise generating device includes a housing member being designed for being gripped by a user. An actuation assembly is coupled to the housing member. The actuation assembly is designed for being actuated by the user. A speaker member is coupled to the housing member. The speaker member is operationally coupled to the actuation assembly whereby the speaker member is designed for being actuated by the actuation assembly to produce the nuisance noise, such as the buzzing sound of a flying gnat or fly, when the actuation assembly is actuated. The housing member is designed for being selectively manipulated by the user to direct the speaker member towards an ear of the person to distract the person with the nuisance noise when the actuation assembly is actuated by the user.

10 Claims, 4 Drawing Sheets

NOISE GENERATING DEVICE

BACKGROUND OF THE INVENTION

1. Field of the Invention

The present invention relates to noise making devices and more particularly pertains to a new noise generating device for generating a nuisance noise to disturb a person.

2. Description of the Prior Art

The use of noise making devices is known in the prior art. U.S. Pat. No. 6,257,949 describes a device for being blown into by a user to generate noise emanating from the armpit of the user. Another type of noise making device is U.S. Pat. No. 5,820,437 having a candy holding device that receives a sucker and noise maker in the housing to generate noise whenever the housing is moved. U.S. Pat. No. 1,959,169 has a cane with a sound producing device positioned in the cane so that the sound producing device produces a sound when the handle of the cane is moved.

While these devices fulfill their respective, particular objectives and requirements, the need remains for a device that has certain improved features allowing for a user to disturb a person undetected.

SUMMARY OF THE INVENTION

The present invention meets the needs presented above by providing a neck portion that can be selectively positioned in a manner to allow the user to position the speaker member proximate the ear of the user without being detected by the person.

Still yet another object of the present invention is to provide a new noise generating device that produces the sound for predetermined amount of time to simulate the insect away from the ear of the person.

To this end, the present invention generally comprises a housing member being designed for being gripped by a user. An actuation assembly is coupled to the housing member. The actuation assembly is designed for being actuated by the user. A speaker member is coupled to the housing member. The speaker member is operationally coupled to the actuation assembly whereby the speaker member is designed for being actuated by the actuation assembly to produce the nuisance noise, such as the buzzing sound of a flying gnat or fly, when the actuation assembly is actuated. The housing member is designed for being selectively manipulated by the user to direct the speaker member towards an ear of the person to distract the person with the nuisance noise when the actuation assembly is actuated by the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
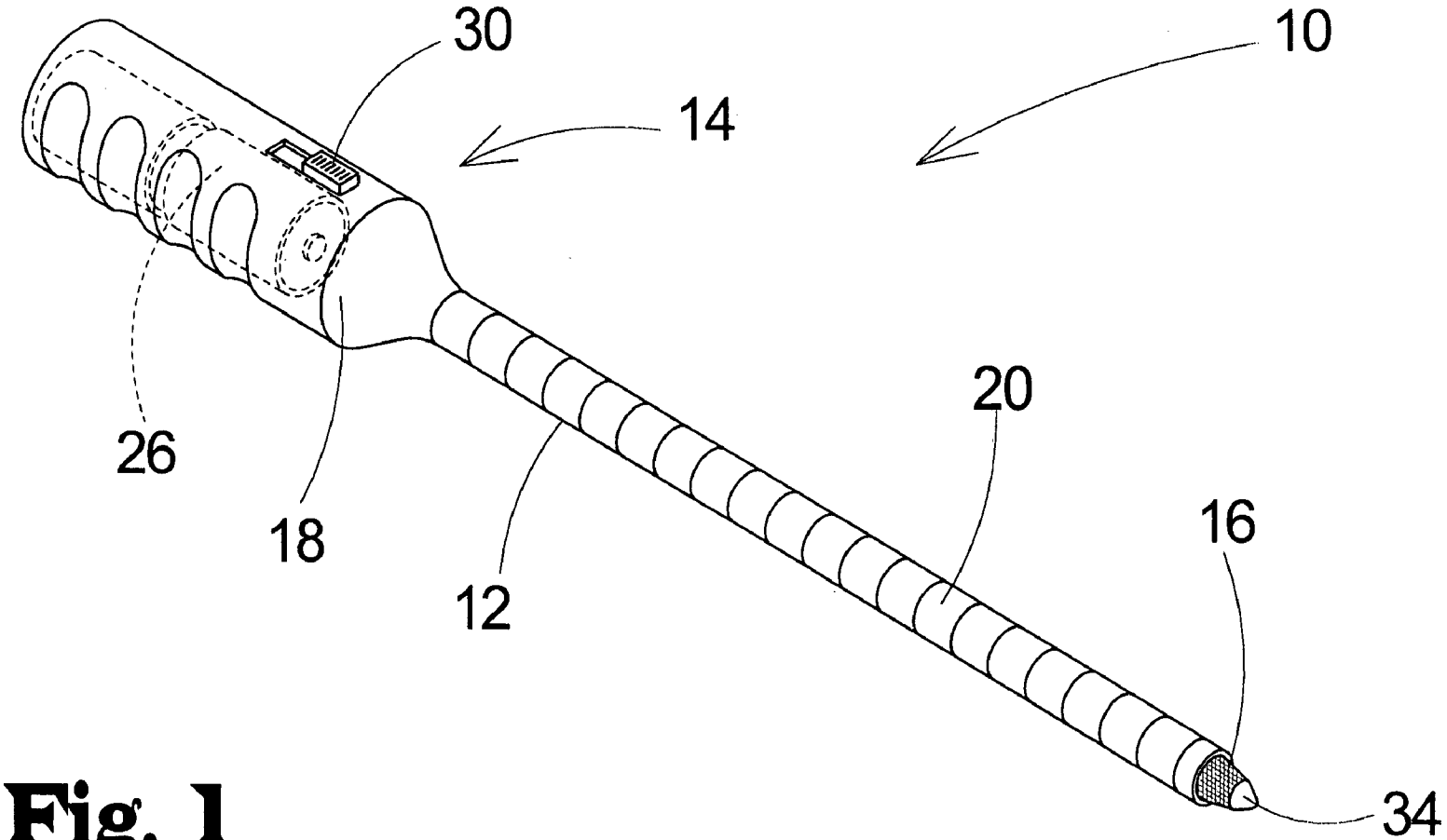
FIG. 1 is a perspective view of a new noise generating device according to the present invention.
Figure 2:
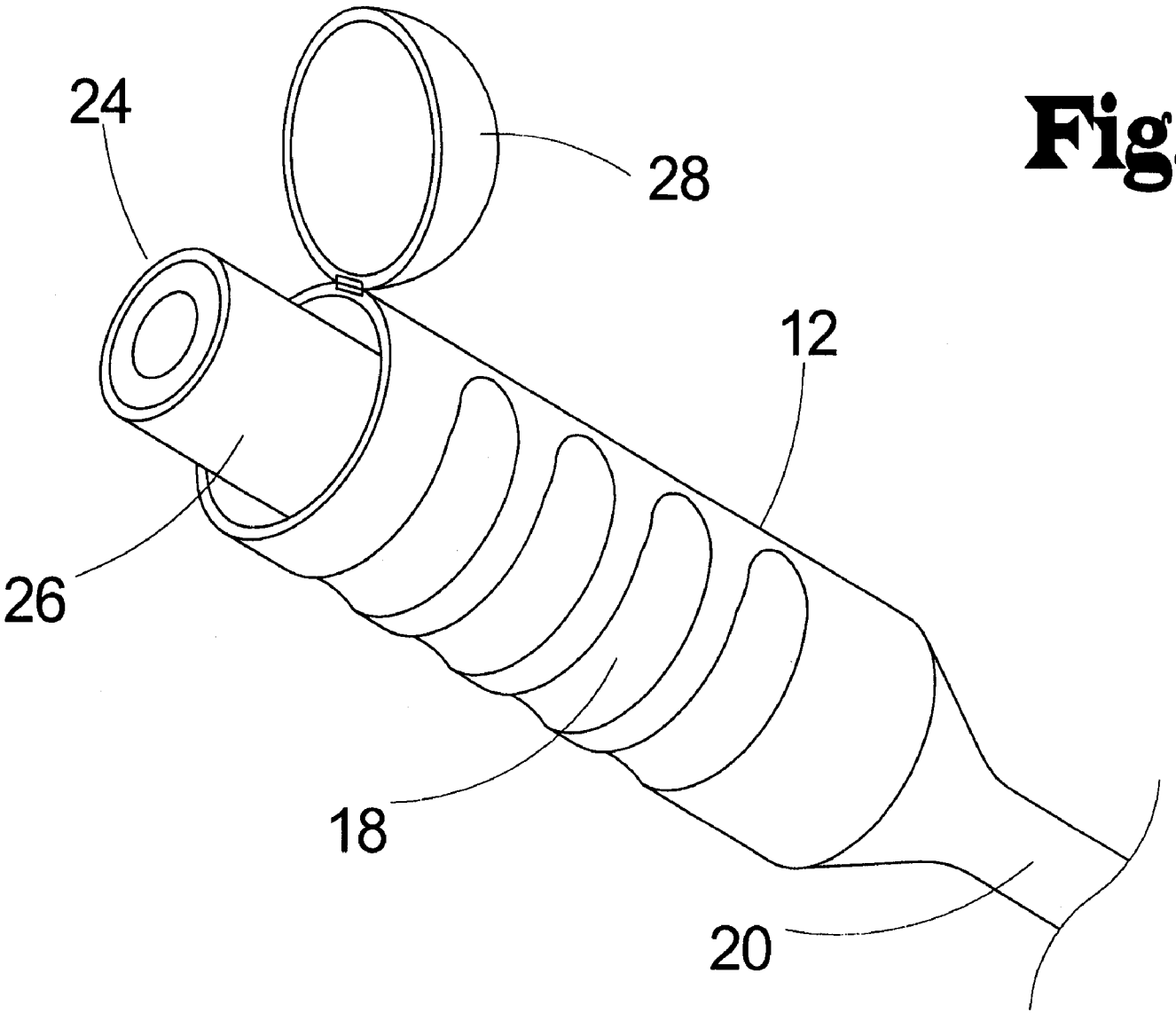
FIG. 2 is a side view of the handle portion and the cover member of the present invention.
Figure 3:
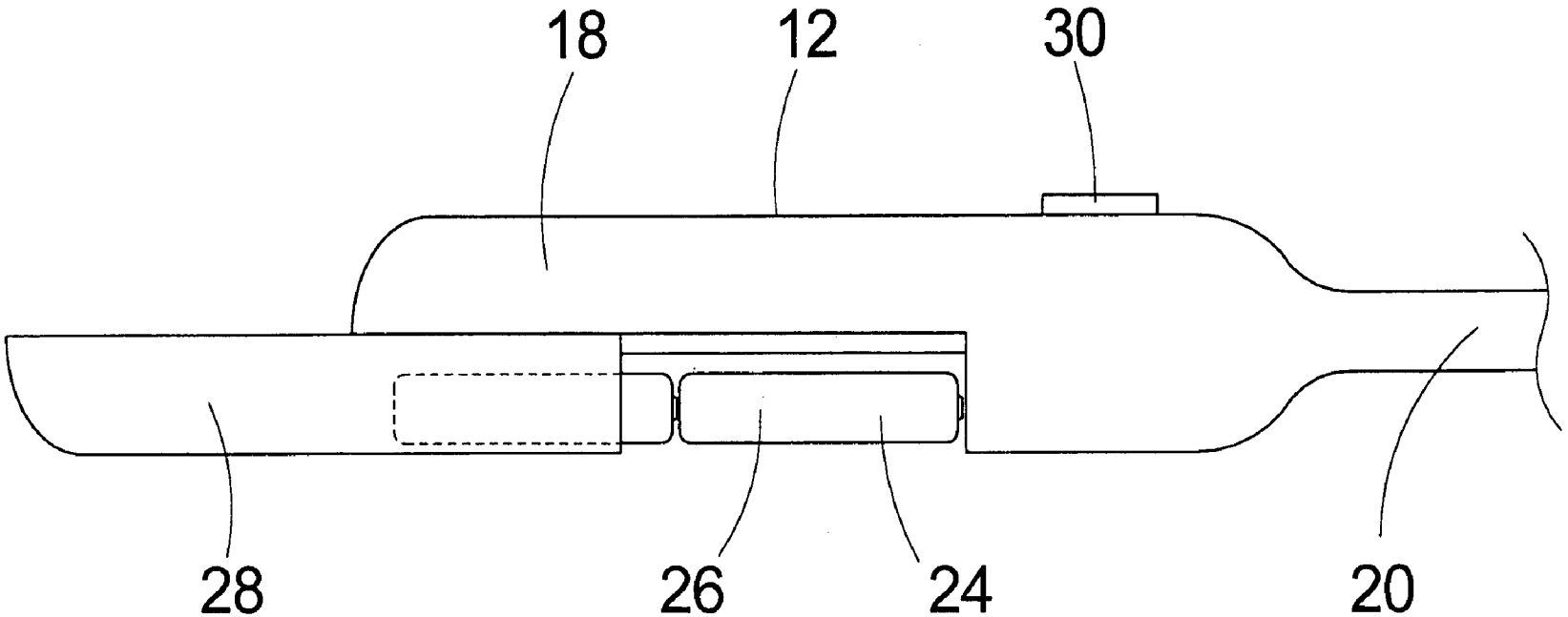
FIG. 3 is a side view of an alternate embodiment of the cover member of the present invention.
Figure 4:
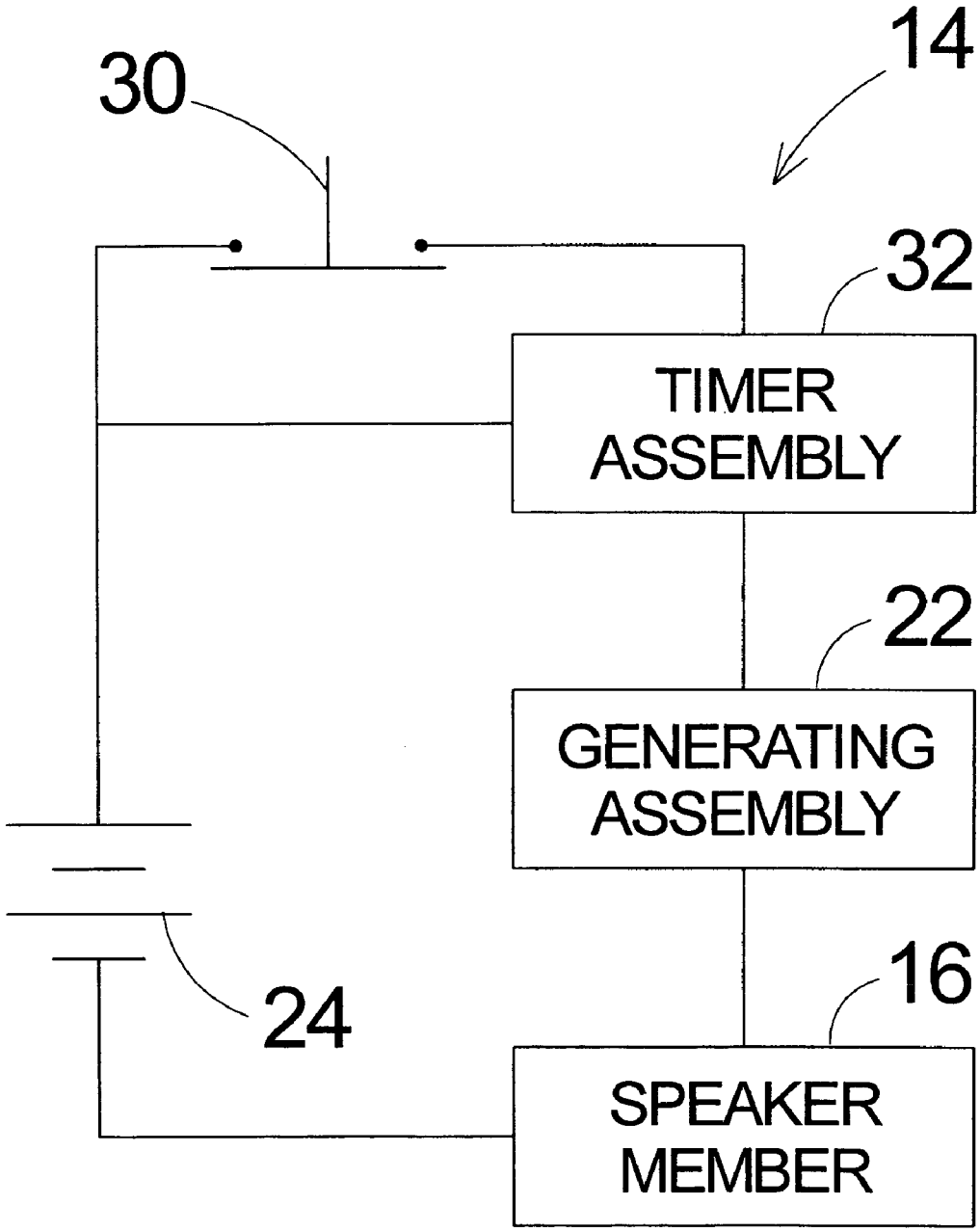
FIG. 4 is a schematic view of the actuation assembly and speaker member of the present invention.

With reference now to the drawings, and in particular to FIGS. 1 through 4 thereof, a new noise generating device embodying the principles and concepts of the present invention and generally designated by the reference numeral 10 will be described.

As best illustrated in FIGS. 1 through 4, the noise generating device 10 generally comprises a housing member 12 being designed for being gripped by a user.

An actuation assembly 14 is coupled to the housing member 12. The actuation assembly 14 is designed for being actuated by the user.

A speaker member 16 is coupled to the housing member 12. The speaker member 16 is operationally coupled to the actuation assembly 14 whereby the speaker member 16 is designed for being actuated by the actuation assembly 14 to produce the nuisance noise, such as the buzzing sound of a flying gnat or fly, when the actuation assembly 14 is actuated. The housing member 12 is designed for being selectively manipulated by the user to direct the speaker member 16 towards an ear of the person to distract the person with the nuisance noise when the actuation assembly 14 is actuated by the user.

The housing member 12 comprises a handle portion 18. The handle portion 18 is designed for being gripped by the user. The actuation assembly 14 is coupled to the handle portion 18 to facilitate actuation of the actuation assembly 14 by the user when the handle portion 18 of the housing member 12 is being gripped by the user.

The housing member 12 comprises a neck portion 20. The neck portion 20 is coupled to the handle portion 18 of the housing member 12 whereby the neck portion 20 extends outwardly from the handle portion 18. The speaker member 16 is coupled to the neck portion 20 opposite the handle portion 18 of the housing member 12. The neck portion 20 is elongated whereby the neck portion 20 is designed for permitting a user to stand at a distance from the person when the user actuates the actuation assembly 14.

The neck portion 20 comprises a resiliently flexible material. The resiliently flexible material permits the neck portion 20 to bent in a variety of positions to allow the user control the direction from which the user introduces the nuisance noise produced by the speaker member 16 to the person.

The actuation assembly 14 comprises a generating assembly 22 and a power supply 24. The generating assembly 22 and the power supply 24 are positioned in the handle portion 18 of the housing member 12. The generating assembly 22 is operationally coupled to the power supply 24 whereby the power supply 24 supplies power to the generating assembly 22. The generating assembly 22 is operationally coupled to the speaker member 16 whereby the generating assembly 22 generates signals to actuate the speaker assembly to generate the nuisance noise when the power supply 24 supplies power to the generating assembly 22.

The power supply 24 comprises at least one battery 26. The battery 26 is selectively positioned in the handle portion 18 of the housing member 12. The battery 26 is operationally coupled to the generating assembly 22 whereby the battery 26 supplies power to the generating assembly 22 when the battery 26 is positioned in the housing member 12.

A cover member 28 is selectively coupled to the handle portion 18 of the housing member 12. The cover member 28 encloses the battery 26 in the handle portion 18 of the housing member 12 when the cover member 28 is coupled to the housing member 12.

The actuation assembly 14 comprises a switch member 30. The switch member 30 is coupled to the handle portion 18 of the housing member 12 whereby the switch member 30 is designed for being selectively actuated by the user. The switch member 30 is operationally coupled between the power supply 24 and the generating assembly 22 whereby the switch member 30 is for controlling the flow of power from the power supply 24 to the generating assembly 22 when the switch member 30 is actuated by the user.

The actuation assembly 14 comprises a timer assembly 32. The timer assembly 32 is operationally coupled to the power supply 24 and between the switch member 30 and the generating assembly 22. The timer assembly 32 is actuated by the switch assembly to allow power to flow from the power supply 24 to the generating assembly 22 for a predetermined amount of time when the switch member 30 is actuated by the user.

A grill member 34 is coupled to the neck portion 20 of the housing member 12 opposite the handle portion 18. The grill member 34 is positioned over the speaker member 16 whereby the grill member 34 is for protecting the speaker member 16 from being damaged and allow the nuisance sound generated by the speaker member 16 to be heard by the person. The grill member 34 is substantially domed shaped. The grill member 34 is designed for permitting the speaker member 16 to produce the nuisance noise in multiple directions to inhibit the person from detecting the direction that the nuisance noise is coming from.

In use, the user bends the neck portion 20*s* into a position that will allow the user to position the speaker member 16 proximate the ear of the person. The user then actuates the switch member 30 so that the speaker member 16 starts generating the nuisance noise. The user then directs the speaker member 16 around the ear of the person to distract the person with the nuisance noise.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A noise generating device for generating a nuisance noise to imitate a sound of a flying insect to distract a person, the noise generating device comprising:

a housing member being adapted for being gripped by a user;

an actuation assembly being coupled to said housing member, said actuation assembly being adapted for being actuated by the user;

a speaker member being coupled to said housing member, said speaker member being operationally coupled to said actuation assembly such that said speaker member is adapted for being actuated by said actuation assembly to produce the nuisance noise when said actuation assembly is actuated, said housing member being adapted for being selectively manipulated by the user to direct said speaker member towards an ear of the person to distract the person with the nuisance noise when said actuation assembly is actuated by the user;

said housing member comprising a handle portion, said handle portion being adapted for being gripped by the user, said actuation assembly being coupled to said handle portion to facilitate actuation of said actuation assembly by the user when said handle portion of said housing member is being gripped by the user;

said housing member comprising a neck portion, said neck portion being coupled to said handle portion of said housing member such that said neck portion extends outwardly from said handle portion, said speaker member being coupled to said neck portion opposite said handle portion of said housing member, said neck portion being elongated such that said neck portion is adapted for permitting a user to stand at a distance from the person when the user actuates said actuation assembly; and said neck portion having a length greater than a length of said handle portion to permit the user to be positioned to remain unnoticed by the person.

2. The noise generating device as set forth in claim 1, further comprising:

said neck portion comprising a resiliently flexible material, said resiliently flexible material permitting said neck portion to bend in a variety of positions to allow the user control of the direction from which the user introduces the nuisance noise produced by said speaker member to the person.

3. The noise generating device as set forth in claim 1, further comprising:

said actuation assembly comprising a generating assembly and a power supply, said generating assembly being operationally coupled to said power supply such that said power supply supplies power to said generating assembly, said generating assembly being operationally coupled to said speaker member such that said generating assembly generates signals to actuate said speaker assembly to generate the nuisance noise when said power supply supplies power to said generating assembly.

4. The noise generating device as set forth in claim 3, further comprising:

said power supply comprising at least one battery, said battery being selectively positioned in said housing member, said battery being operationally coupled to said generating assembly such that said battery supplies power to said generating assembly when said battery is positioned in said housing member.

5. The noise generating device as set forth in claim 4, further comprising:

a cover member being selectively coupled to said housing member, said cover member enclosing said battery in said housing member when said cover member is coupled to said housing member.

6. The noise generating device as set forth in claim 3, further comprising:

said actuation assembly comprising a switch member, said switch member being coupled to said housing member such that said switch member is adapted for being selectively actuated by the user, said switch member being operationally coupled between said power supply and said generating assembly such that said switch member is for controlling the flow of power from said power supply to said generating assembly when said switch member is actuated by the user.

7. The noise generating device as set forth in claim 6, further comprising:

said actuation assembly comprising a timer assembly, said timer assembly being operationally coupled to said power supply and between said switch member and said generating assembly, said timer assembly being actuated by said switch assembly to allow power to flow from said power supply to said generating assembly for a predetermined amount of time when said switch member is actuated by the user.

8. The noise generating device as set forth in claim 1, further comprising:

a grill member being coupled to said housing member, said grill member being positioned over said speaker member such that said grill member is for protecting said speaker member from being damaged and allow the nuisance sound generated by said speaker member to be heard by the person.

9. The noise generating device as set forth in claim 8, further comprising:

said grill member being substantially domed shaped, said grill member being adapted for permitting said speaker member to produce the nuisance noise in multiple directions to inhibit the person from detecting the direction that the nuisance noise is coming from.

10. A noise generating device for generating a nuisance noise to imitate a sound of a flying insect to distract a person, the noise generating device comprising:

a housing member being adapted for being gripped by a user;

an actuation assembly being coupled to said housing member, said actuation assembly being adapted for being actuated by the user;

a speaker member being coupled to said housing member, said speaker member being operationally coupled to said actuation assembly such that said speaker member is adapted for being actuated by said actuation assembly to produce the nuisance noise when said actuation assembly is actuated, said housing member being adapted for being selectively manipulated by the user to direct said speaker member towards an ear of the person to distract the person with the nuisance noise when said actuation assembly is actuated by the user;

said housing member comprising a handle portion, said handle portion being adapted for being gripped by the user, said actuation assembly being coupled to said handle portion to facilitate actuation of said actuation assembly by the user when said handle portion of said housing member is being gripped by the user;

said housing member comprising a neck portion, said neck portion being coupled to said handle portion of said housing member such that said neck portion extends outwardly from said handle portion, said speaker member being coupled to said neck portion opposite said handle portion of said housing member, said neck portion being elongated such that said neck portion is adapted for permitting a user to stand at a distance from the person when the user actuates said actuation assembly;

said neck portion comprising a resiliently flexible material, said resiliently flexible material permitting said neck portion to bend in a variety of positions to allow the user control of the direction from which the user introduces the nuisance noise produced by said speaker member to the person;

said actuation assembly comprising a generating assembly and a power supply, said generating assembly and said power supply being positioned in said handle portion of said housing member, said generating assembly being operationally coupled to said power supply such that said power supply supplies power to said generating assembly, said generating assembly being operationally coupled to said speaker member such that said generating assembly generates signals to actuate said speaker assembly to generate the nuisance noise when said power supply supplies power to said generating assembly;

said power supply comprising at least one battery, said battery being selectively positioned in said handle portion of said housing member, said battery being operationally coupled to said generating assembly such that said battery supplies power to said generating assembly when said battery is positioned in said housing member;

a cover member being selectively coupled to said handle portion of said housing member, said cover member enclosing said battery in said handle portion of said housing member when said cover member is coupled to said housing member;

said actuation assembly comprising a switch member, said switch member being coupled to said handle portion of said housing member such that said switch member is adapted for being selectively actuated by the user, said switch member being operationally coupled between said power supply and said generating assembly such that said switch member is for controlling the flow of power from said power supply to said generating assembly when said switch member is actuated by the user;

said actuation assembly comprising a timer assembly, said timer assembly being operationally coupled to said power supply and between said switch member and said generating assembly, said timer assembly being actuated by said switch assembly to allow power to flow from said power supply to said generating assembly for a predetermined amount of time when said switch member is actuated by the user;

a grill member being coupled to said neck portion of said housing member opposite said handle portion, said grill member being positioned over said speaker member such that said grill member is for protecting said speaker member from being damaged and allow the nuisance sound generated by said speaker member to be heard by the person; and said grill member being substantially domed shaped, said grill member being adapted for permitting said speaker member to produce the nuisance noise in multiple directions to inhibit the person from detecting the direction that the nuisance noise is coming from.

* * * * *